US005765583A

United States Patent [19]

Gamper

[11] Patent Number: 5,765,583

[45] Date of Patent: Jun. 16, 1998

[54] COLLAPSIBLE CRUTCH

[76] Inventor: William B. Gamper, 3064 Ramsgate Way, Rancho Cordova, Calif. 95670

[21] Appl. No.: 855,838

[22] Filed: May 12, 1997

[51] Int. Cl.[6] ..... A61H 3/02

[52] U.S. Cl. ..... 135/68; 135/65; 135/66; 135/69; 135/75

[58] Field of Search ..... 135/65, 66, 68, 135/69, 75

[56] References Cited

U.S. PATENT DOCUMENTS

| | | | |
|---|---|---|---|
| 1,156,747 | 10/1915 | Briscoe | 135/69 |
| 2,264,015 | 11/1941 | Bennett | 135/69 |
| 2,426,074 | 8/1947 | Watters | 135/69 |
| 2,544,957 | 3/1951 | Henry | 135/69 |
| 2,641,491 | 6/1953 | Mueller et al. | 285/39 |
| 3,730,198 | 5/1973 | Johnston et al. | 135/69 |
| 4,182,364 | 1/1980 | Gilbert et al. | 137/426 |
| 4,509,741 | 4/1985 | Smith | 135/69 X |
| 4,865,065 | 9/1989 | Chen | 135/69 |
| 4,979,533 | 12/1990 | Hansen et al. | 135/69 |
| 5,025,820 | 6/1991 | Gamper | 135/69 |
| 5,139,040 | 8/1992 | Kelly | 135/69 |
| 5,351,701 | 10/1994 | Hsiao | 135/68 |
| 5,402,811 | 4/1995 | Weng | 135/68 |
| 5,458,145 | 10/1995 | Davis | 135/68 |
| 5,482,070 | 1/1996 | Kelly | 135/66 |
| 5,605,170 | 2/1997 | Weng | 135/68 |

*Primary Examiner*—Wynn Wood Coggins
*Attorney, Agent, or Firm*—Mark C. Jacobs

[57] ABSTRACT

A self-adjusting crutch having a floating and moveable central leg. A prepositionable height fastener cooperates with a coupling collar, both of which are disposed on the central leg to predetermine the amount of extension. A fastener and coupler cooperate, for the leg to be extended and retracted repeatedly the exact same distance. The floating moveable leg can be releasably retained within the arm piece.

22 Claims, 4 Drawing Sheets

COLLAPSIBLE CRUTCH

RELATIONSHIP TO OTHER APPLICATIONS AND PATENTS

This application constitutes an improvement to the technology disclosed and claimed in Gamper, U.S. Pat. No. 5,025,820 issued Jun 25, 1991.

BACKGROUND OF THE INVENTION

During the last century there have been numerous attempts to develop collapsible crutches. For the most part, these crutches, while collapsible require significant time and effort to reduce them in elongation. Some of the crutches feature a telescoping tubular lower member wherein the inner section is retained as by a cross bolt and nut within a slightly wider outer section. For these it is necessary for the user to sit down in order to collapse the crutch for ready temporary storage as in the rear seat of a car, at a restaurant, theater or other public place. Hence in each case, when the destination is reached or the event is over, again significant effort must be exerted to re-extend the telescoping leg to its desired position. Sometimes it is difficult to relocate the exact length of the telescoping member in order to determine the desired elongation of the crutch.

While there was a need therefore, for a self-adjusting collapsible crutch, such was initially achieved in my aforementioned U.S. patent. It is an object therefore of this invention to provide an improved version of my collapsible crutch. For example, one of the encumbrances found in my previous patented structure is the fact that the fixed leg cannot be exactly disposed relative to the moveable leg because it swings relatively free on one end. Thus one can experience difficulty in either or both of extending and retracting the central portion. This can also occur if the valve isn't completely open. Also, since the fixed leg is of the narrowest diameter of tubing employed, for weight considerations, should the fixed leg get bent slightly, further difficulty in operation and therefore in use of the crutch will be experienced.

It is a first object therefore to provide an improved self-adjusting collapsible crutch.

It is yet another object to provide a collapsible crutch that can be closed while the user is in either the standing or sitting position and which crutch needs no tools for extension and reduction in elongation.

It is yet another object to provide a crutch that has a central leg that requires no permanent attachment to the arm piece.

It is still another object to provide a collapsible crutch whose central leg is releasably securable to the arm piece when in the stowed position.

It is yet another object to provide a locking means for the leg when, in the extended position, which means will neither tighten or loosen when in use.

It is yet further the object to increase the stability of the central moveable leg by lengthening the barrel of the boot without losing any portability from the previous design.

It is a still further object to provide a collapsible crutch with an improved support handle.

These and other objects of the invention will in part be obvious and will in part appear hereinafter.

The invention accordingly comprises the product possessing the features, properties and the relation of components which are exemplified in the following detailed disclosure and the scope of the application of which will be indicated in the claims.

For a fuller understanding of the nature and objects of the invention reference should be made to the following detailed description taken in conjunction with the accompanying drawings.

KNOWN PRIOR ART

As a result of a patent novelty search prior to filing my first patent application, which is now the above-referenced patent, applicant became aware of the following references:

| | |
|---|---|
| 2,426,074 | Watters |
| 2,264,015 | Bennett |
| 1,156,747 | Briscoe |
| 2,544,957 | Henry |
| 2,641,491 | Mueller |
| 4,182,364 | Gilbert |

Prior to the filing of this application, further research by the Examiner during the prosecution of my first patent application, and by me years subsequent to its issuance, made me aware of the following additional references:

| | |
|---|---|
| 3,730,198 | Johnston, et al |
| 4,979,533 | Hanson et al |
| 5,139,040 | Kelly |
| 5,351,701 | Hsiao |
| 5,402,811 | Wong |
| 5,458,145 | Davis |
| 5,482,070 | Kelly |

The subject matter of the claims set forth below is not disclosed nor is it obvious from any of the references cited above, alone or in combination with each other.

SUMMARY OF THE INVENTION

A self-adjusting height crutch which contains a moveable central leg. A prepositionable height fastener cooperates with a coupling collar, both of which are disposed on the central leg to predetermine the amount of extension of the moveable central leg. When the height fastener has been located and the coupler is changed from an "in" to an "out" of cooperation disposition, the leg can be extended and retracted repeatedly the exact same distance, with improved ease of function and increased utility. When in retracted "out of use" position, the central leg is retained in a releasable position within the arm piece.

DESCRIPTION OF THE PREFERRED EMBODIMENT

Figure 1:
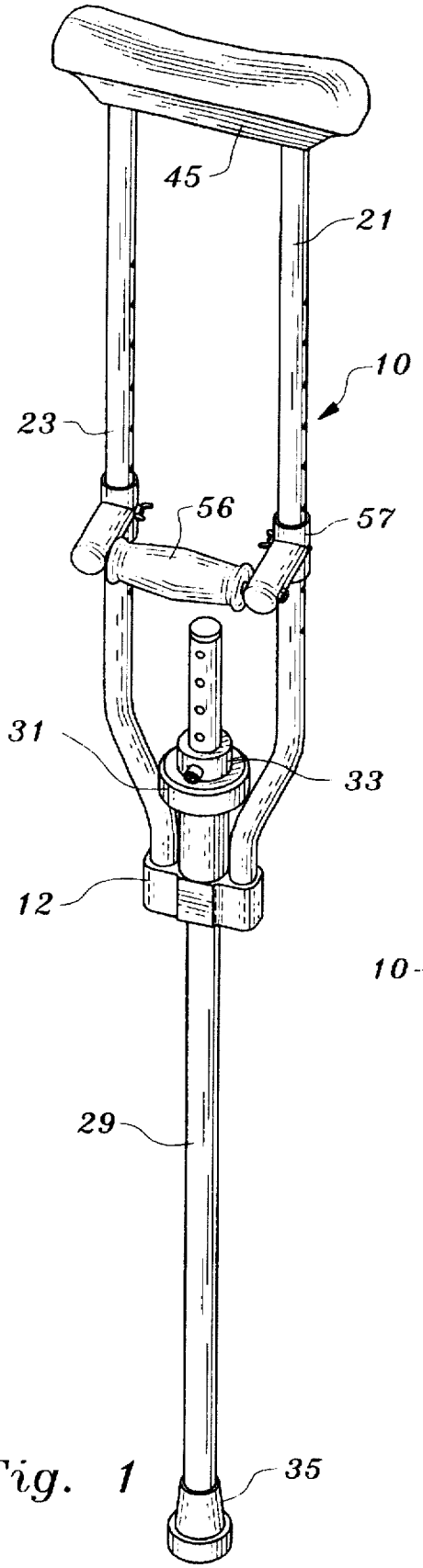
FIG. 1 is a front perspective view of this invention.

The crutch of this invention is seen in its entirety in FIG. 1, and is generally formed of a pair of spaced lateral fixed posts, 21, 23 which are retained in an arm piece 45, at their upper end, and in a base boot 12 at their lower end. Intermediate these posts is a central moveable post 29 with the moveable post projecting through the base boot 12 for contact with the ground.

Figure 2:
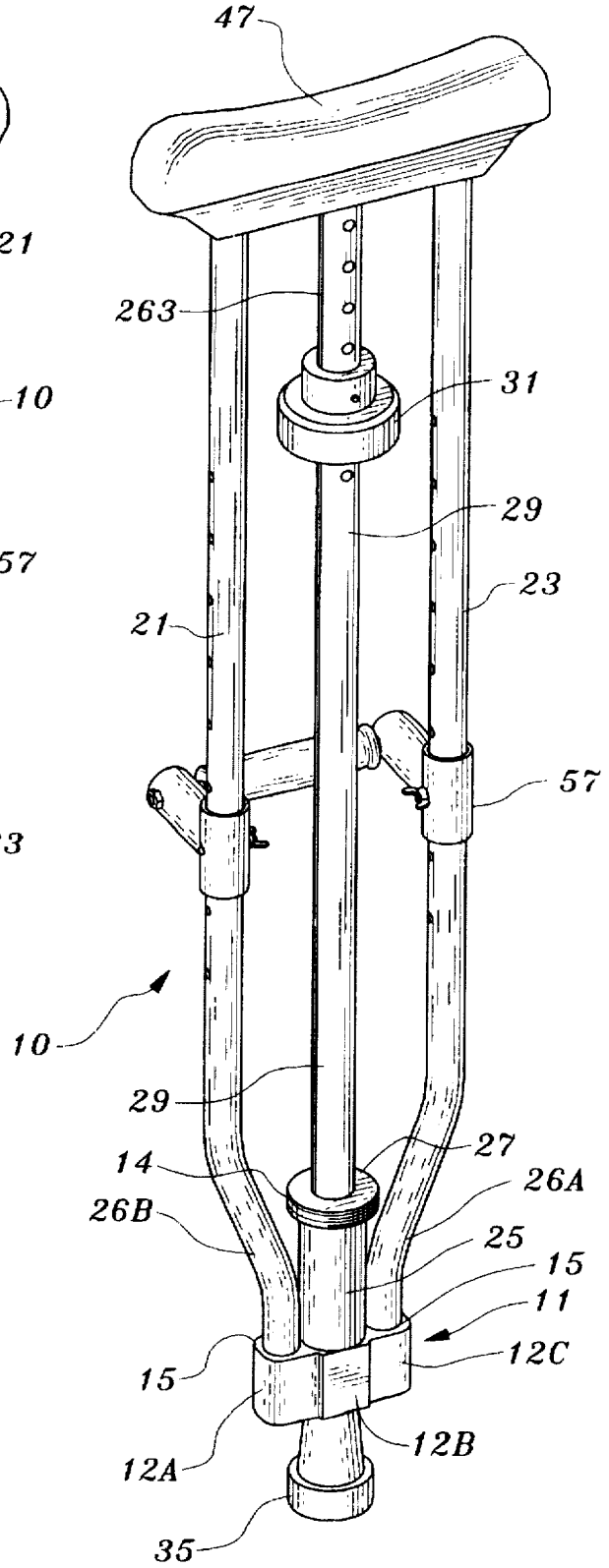
FIG. 2 is a rear perspective view thereof with the moveable central leg in a retracted position.

Turning now to FIG. 1 and 2, there is shown the crutch 10, of this invention. The crutch 10 features an arm piece 45, which will be described in detail infra. From this arm piece descend two spaced lateral posts 21, 23. These are of a fixed length, of about 30" in length, and constructed of tubing about 0.75 to 1" in diameter and extend from the arm piece 45 at their upper ends to locations on the base boot 12 at their respective lower ends. These exterior lateral posts may extend straight down, but preferably the lower portions of each, 26A & B, extend downwardly and toward each other and then extend straight downward in parallel with each other but with a lesser distance between them. This may be referred to as a swaged area. See FIG. 2.

Figure 6:
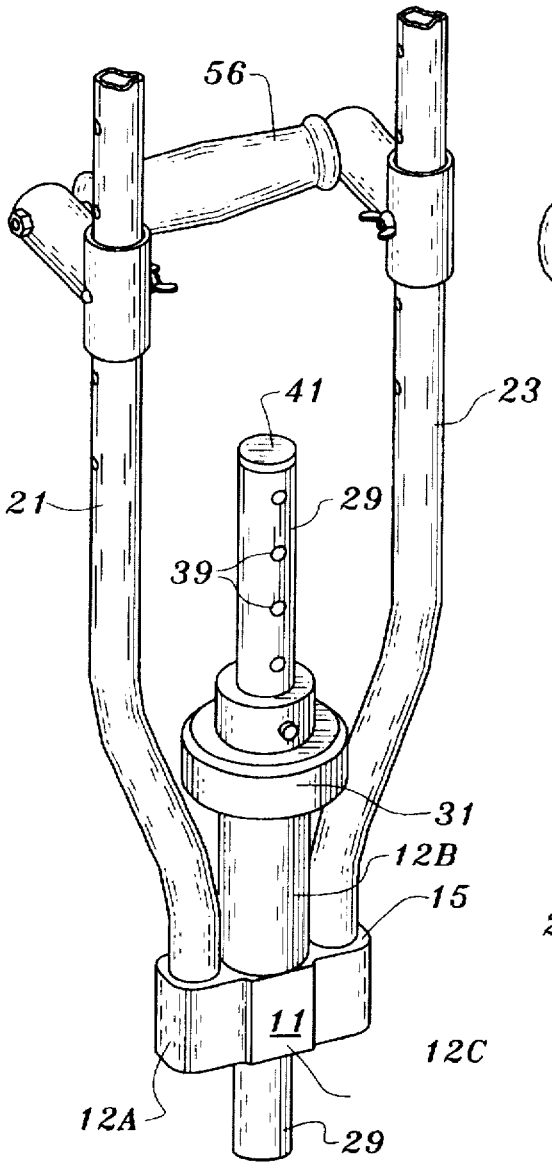
FIG. 6 is a close-up view of the intermediate area of the invention, depicting part of the central leg with the coupler coupled.

A central leg 29 is removably disposeable within the arm piece 45, at its upper end. An extension coupler 25 forms part of the base boot 11 at its lower end. Details of the central leg will be held in abeyance until after the discussion of the base boot, 11. See also FIG. 6.

Base boot 11 is a generally inverted T-shaped member with a trio of upwardly extending arms, 12A, 12B and 12C the outer two of which may be shorter than the center arm. Thus boot 11 incudes a trio of linearly aligned arms, extending upwardly, the first of which shall be arbitrarily be referred to as a left arm 12A, extending upwardly from a base 12B. Spaced from left arm 12A and extending upwardly adjacent thereto is taller middle arm 12B and adjacent thereto is right arm 12C, similar to 12A. Each of these arms 12A–12C contains an opening therein at the top of the boot 11 just short of being a throughbore. The diameter of the central arm is preferably greater than that of the lateral arms 12A, C, for reasons that will appear obvious from the discussion below. The central arm 12B terminates at its upper end in an integral extension coupler, 25, extending upward therefrom which coupler has an externally threaded area optionally of a slighter larger diameter than the balance of the coupler, and designated 27. The threads of the enlarged section 27 are designated 14.

Figure 4:
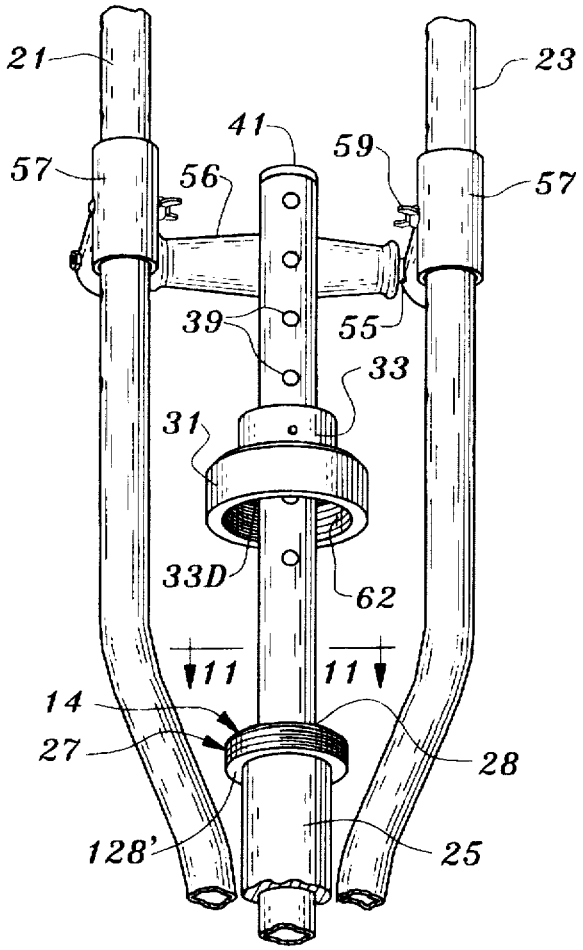
FIG. 4 is a close-up rear elevational view of the intermediate area of this invention with the coupler uncoupled.
Figure 5:
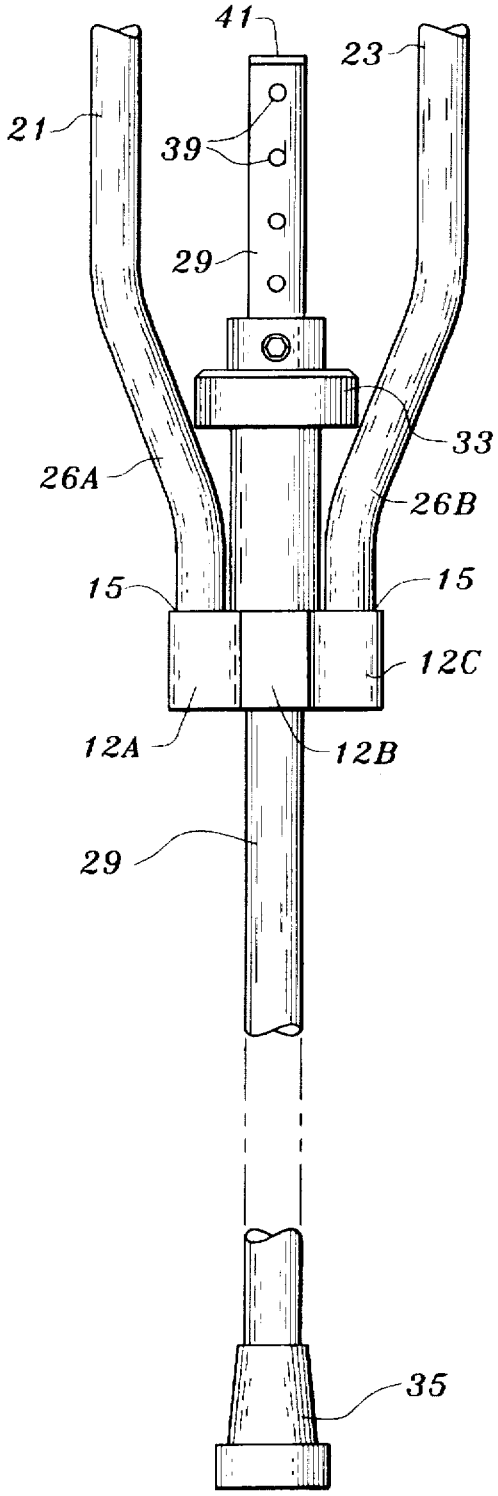
FIG. 5 is an elevational view of the lower portion of this invention.

Boot 11's details may be seen in FIG. 5. Thus each lateral arm 12A, 12C includes a top opening 15, while center arm 12B includes a top exterior threaded opening 14. See FIG. 4. Rivets, screws or bolts, not shown may be associated with each lateral arm, to pin the exterior posts 21, 23 into their respective opening 15 to secure posts 21, 23 into the boot 11. If desired for cosmetic reasons to friction fit the arms into the boot 12, and preferably adhese the arms into the openings 15.

As noted previously, the taller central arm 12B is externally threaded, 14—discussed infra—at its upper end 12B', to receive the internal threads 26 of the annular-shaped extension coupling collar 31. See also FIG. 4.

Central arm 12B, which has an attached upwardly extending section coupler 25 which forms the leg of the inverted Tee, boot 11, contains a central opening 28 therethrough. This extending section 25, the extension coupler, includes an area of greater diameter 27 upon which are the aforementioned threads 14 to matingly engage collar 31's interior threads 26 as seen in the cutaway area of coupler 31 in FIG. 9.

The discussion moves now to the central leg 29. The central leg 29, may be metal such as aluminum, or plastic such as polycarbonate and of maybe ¾ to 1 inch in diameter. It, 29, features a plurality of vertically spaced height adjustment bores 39 on at least one quadrant of the tubular member. These bores may also comprise through bores, and as such would be found on two quadrants of the perimeter of the moveable post, 29. See FIGS. 3, 4, and 6.

Figure 9:
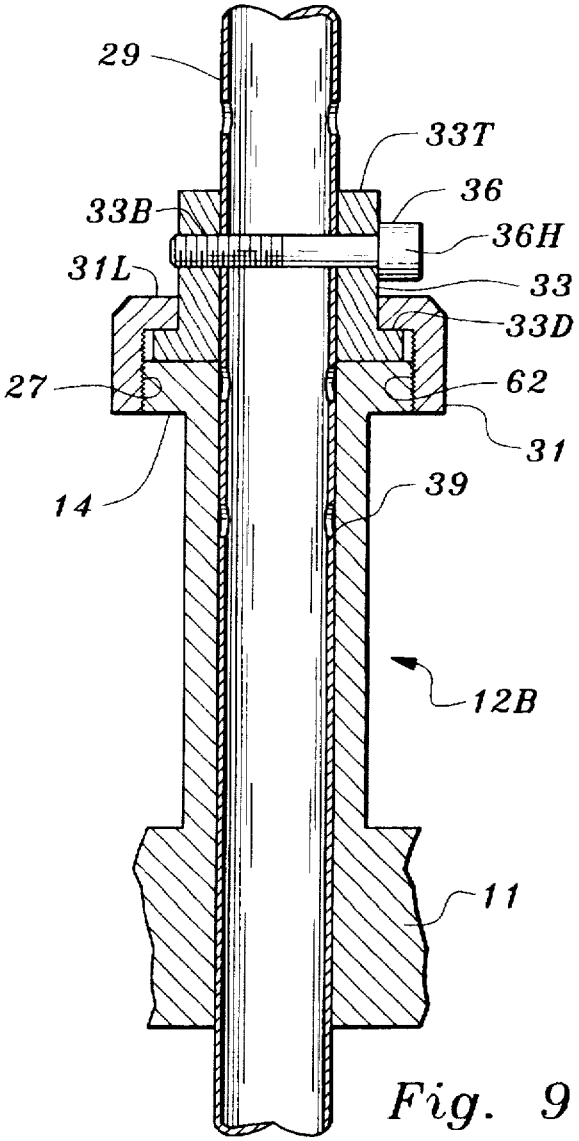
FIG. 9 is an elevational sectional view of the coupler in a coupled position.

These height adjustment bores are utilized by the height adjustment fastener 33, which comprises a tubular member 33T—per FIGS. 4, 9 having a disc washer 33D of greater diameter attached on its underside. See FIG. 4. The center opening in the collar 31 and the disc washer 33D are of the same diameter, per FIG. 9. Elements 33T and D are integrated as by adhering or otherwise securing one to the other.

The diameter of disc 33D is sized to be small enough to pass through the interior of coupling collar 31, but wide enough to permit the inward extending top lip 31L of coupling collar 31 to rest thereupon. See FIG. 9.

The height adjustment fastener 33 also includes a pair of aligned bores, one or both of which may be threaded through the wall of the tubular section 33T which bores pair is designated 33B, see FIG. 9. This bore pair receives an Allen-type self-threading screw 36, per FIGS. 3, and 9 for insertion into one of the aligned pair's height adjustment bores 39 and out again to be threaded into the opposing aligned bore. See FIG. 9. Such insertion constitutes the mode of presetting the height adjustment of the moveable leg of the crutch for a limit of its downward travel. The screw 36 is termed an Allen-type, and not an Allan screw since it can be rotated by the use of an Allen wrench placed in the head 36H, but also because the head is enlarged and is preferably knurled to permit hand tightening, the recommended procedure for tightening adjustment thus eliminating any tool requirement.

Coupling collar 31 is tubular section in configuration and includes an inward extending circumscribing top lip 31L per FIG. 9. Coupling collar 31 also includes internal threads 62 which threadedly engage the exterior threads 27 of coupler 25 portion of the central arm 12B. See supra.

It is also to be noted that head 36H of the Allen type screw 36 serves as a stop and when disposed in place serves as an upward movement limiting means to prevent the upward mobility of the coupling collar 31. When screw 36 is not disposed in place, collar 31 is capable of movement elevationally above element 33. See FIG. 9. Otherwise in the unthreaded condition, the coupling collar 31 rests on the downward movement limiting means of the height adjustment fastener 33; namely, the wider diameter section 33D.

In FIGS. 2 and 5 it is seen that the upper end of the moveable central leg 29 is closed off by a cap 41, which cap may have a friction fitting finger disposed into the open end of the moveable central leg 29. Such caps are readily available in the marketplace to close off pipe sections.

Adhesive may be used in concert with the fingers preferably this cap 41 is of a magnetic material such as chrome plated steel for reasons to be explained below.

Whereas in my previous U.S. Pat. No. 5,025,820 I utilized a fixed central leg in conjunction with the moveable post and a compression valve system to control elevation and stability of the central leg, neither of these elements is utilized in this invention.

Contrast the relative positioning of the moveable leg 29, in FIGS. 1 and 2. The fixing of the downward mobility of the moveable leg is obtained by the positioning of the fastener 36 to the post. The leg is then coupled into its downward in use position by the coupling of internal threads 26 to external threads 14 of section 27 per FIG. 4. Since the Allen-type screw prevents the disposition of the moveable post 29 past the collar, repeated threading and unthreading will always return the moveable leg to the same downward disposition.

The upward disposition of the moveable post 29 is limited by the presence of arm piece 45. Arm piece 45 has three receivers, for the posts. See FIG. 10. Two receivers, 48 and 50 receive the two external lateral posts 21, 23 for fixed disposition therein by any conventional means. The central reciever 49 is generally rectangular and includes a pair of spaced walls 52 which are disposed normal to the front and rear walls 45F and 45R of the arm piece 45 to form the central receiver. Disposed within this defined recess is a magnetic pad, 54, which can releaseably maintain the magnetic material cap 41 of leg 29 when the cap 41 is placed up against it. This magnetic attraction, retains the movable post in a reversibly fixed upper or closed position at the exact extension of the movable post as is desired by the crutch user as determined by the location of screw 36.

Figure 10:
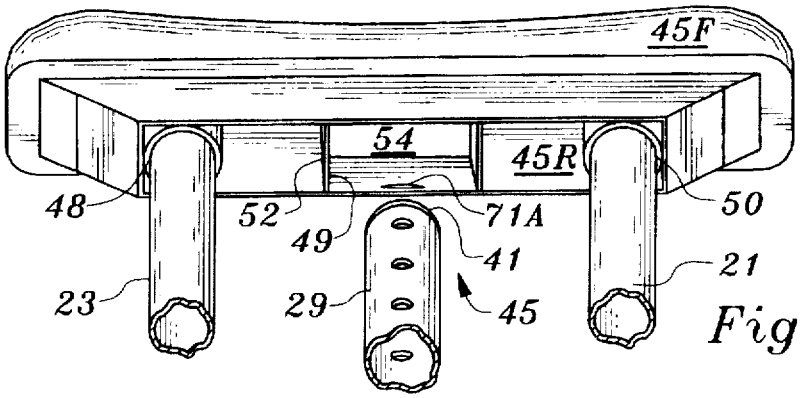
FIG. 10 is an bottom perspective view of the arm piece of this invention.
Figure 14:
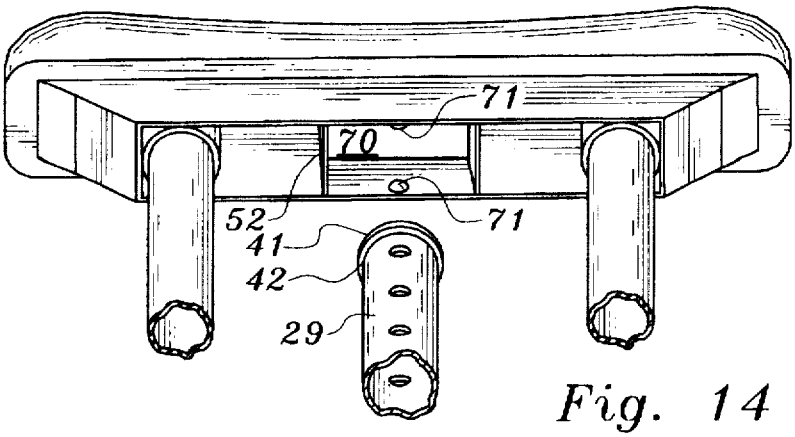
FIG. 14 is a perspective view showing two related means of retaining the moveable post within an upper retention means.

Reference is now made to FIG. 14 where an alternate upper retention means is shown for the moveable post 29. Here the cap 41, which has a diameter slightly wider than that of the central leg, is covered with an adhesive tab of male Velcro® or other hook and loop fastener material. A matingly engageable female section thereof 70 is disposed within the recess defined by the walls aforementioned of the central receiver 49. A pair of optional crimps 71A as depicted in FIG. 10 but not discussed, or spring loaded snaps 71, conventionally available in the marketplace as shown disposed in the front and rear walls 45F, 45R of the arm piece, assist in the retention of the central leg 29 in the upward position during periods of stowage.

Figure 3:
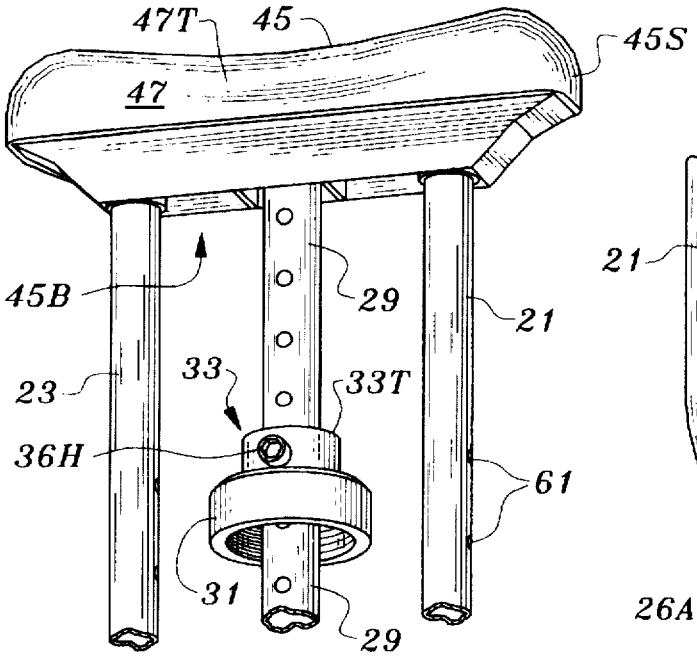
FIG. 3 is a close-up view of the coupler for the fixing of the elevation of the moveable post of this invention.

By turning now to the details of FIG. 3, one sees the connection of the three posts to arm piece 45. Arm piece 45 is of a generally rectangular configuration having spaced front and rear walls and spaced side walls 45S and having an open bottom 45B and a solid top wall 45T. Depending down from the top wall within the interior are the trio of aligned post receivers 48, 49 and 50 previously discussed. Each post receiver is slightly larger in diameter than the post it receives in order to achieve a snug friction fit prior to the optional pinning or other securing of the external lateral posts into a fixed position. Arm piece 45 is protected by arm piece cover 47 which is made of cloth or rubber and which fits over the arm piece 45 as is known in the art. See FIGS. 2 & 3.

Figure 8:
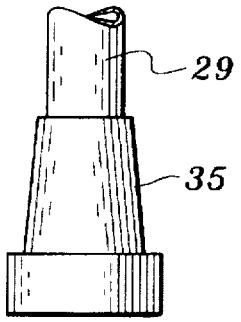
FIG. 8 is a close-up elevational view of a detail shown in FIG. 1.

At the opposite end of the crutch from the arm piece is the bottom of the central leg 29. Thus FIG. 8 depicts a cutaway view of the central leg 29 with a conventional rubber foot 35 mounted thereon. This may be by friction fit or adhesive, all of which are again traditional in the crutch art.

Figure 7:
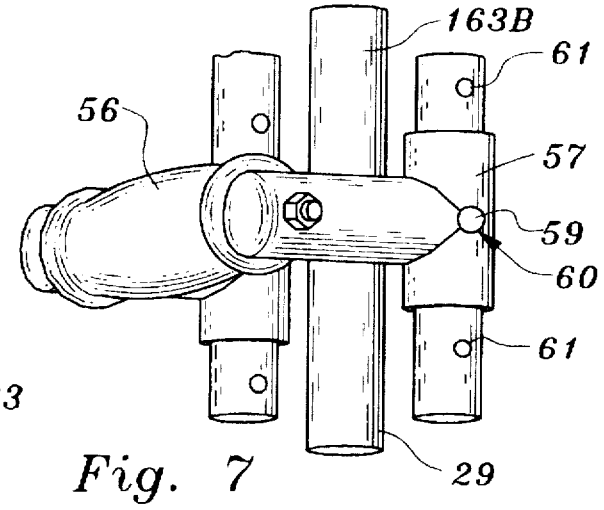
FIG. 7 is a close-up view of the T-handgrip retainers.

Referring now to FIGS. 4 and 7, it is seen that a pair of tubular T-hand grip retainers 57 are mounted at the same elevation on each of the lateral posts via bolts secured by wing nuts, the combination being designated 59. These bolts are inserted into bores 60, which bores 60 align with bores 61 not seen in each lateral post in FIG. 7. Thus the hand grips can be adjusted upwardly or downwardly to suit the needs of the user. A generally tubular hand grip 55 is fixedly attached by any convenient method to the retainers 57. The outward extending section of each T may be of any suitable shape to be engaged by or attachable to the arms of the hand grip 55. A cover 56 of soft rubber may be disposed over the handgrip 55.

The handgrip cover 56 may be affixed slightly rotatably depending upon the snugness of the fit of the cover 56 over the grip 55. Experience has shown that a fixed handgrip is preferable to a rotatable one to avoid part wear, and for safety reasons pertaining to the user's grip. While the cover can be permitted to move slightly, the grip itself should not rotate like a toilet paper holder. If desired, one may utilize a specifically sculpted configuration of the cover 56 to replace the soft rubber tubular member 56.

Figure 11:
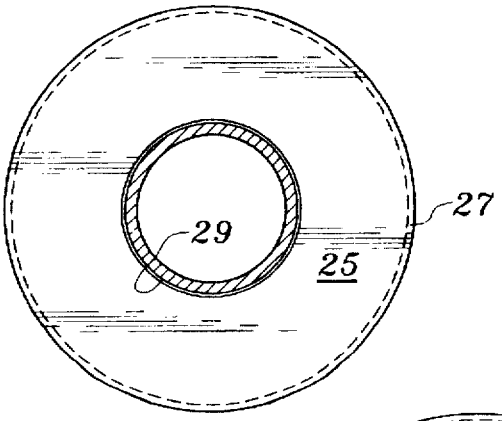
FIG. 11 is a sectional view of the positioning of the foot and the coupler taken along line 11—11 of FIG. 4.
Figure 12:
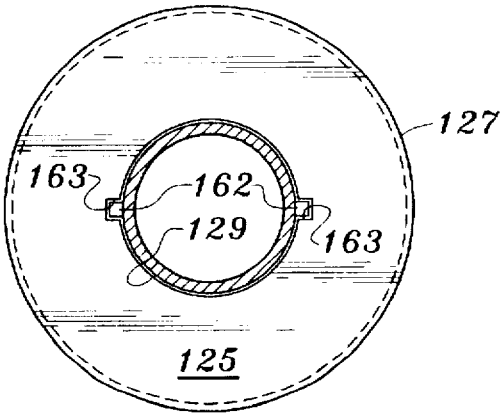
FIG. 12 is a diagrammatic view of a variant of the same portion of the invention as FIG. 11 at what would be the same location.

In FIG. 11, the relative disposition of the moveable post 29 within the extension coupler 25 is seen. While rotational movement of the post 29 therein is a likelihood, when using a proportionate size of the coupler, applicant has devised a counter measure to ensure that such does NOT transpire. See FIG. 12, wherein the post 29 has been renumbered post 129. Molded or otherwise attached along the length of the post 29 is an alignment strip 162. While two are shown, only one is needed. Strips 162 are shown on opposite sides of the leg 29. These are matingly received in recesses 163 of the threaded area 27 of the coupler 25. Thus rotational movement is prevented. Alternatively, the central leg 129 may have an intrusion or two along its outer perimeter 162A per FIG. 13 for engagement by extrusion 163A of the threaded area 27 of coupler 25.

Figure 13:
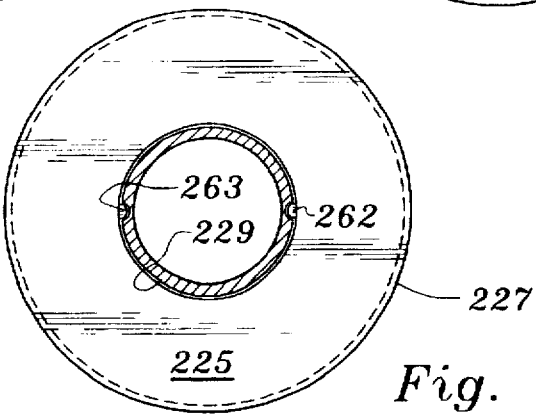
FIG. 13 is a view similar to FIG. 12, with one element thereof in a mirror image position.

Since the use of the intrusion 163A, 162A per FIG. 13 is the preferred mode, one such intrusion or groove 163A is shown also in FIG. 2 for ease and convenience but the designator 29 is retained in that figure.

ADJUSTMENT OPERATION

Reference is made again to FIGS. 1, 2, 5 and 9. FIG. 2 shows the crutch 10 of this invention in the closed or storage position, while FIGS. 1 and 5 show the crutch or a portion thereof in its extended or use position. In FIG. 2, the first or stored position, the coupling collar 31 will rest on the disc 33D of the height adjustment fastener 33 wherever that has been preset as previously discussed per FIG. 9.

In order to utilize the crutch, the cap 41 of the crutch is manually removed by a downward yank from its set position within receiver 49. The crutch is held vertically to permit the moveable central leg 29 or 129 to move downwardly through the coupler 25 until the disc 33D mounted on the moveable central leg 29 comes to rest upon coupler 25. The user may hold the crutch upward at a convenient height, but vertically, with one hand and then couples the coupling collar 31 to coupler 25 by engaging the threads of the coupler 14 to those of the collar, 26.

To return the crutch to the storage position, the procedure is merely reversed.

It is seen that any suitable materials such as plastic or metal or wood, as employed in conventional crutches, may be employed for the crutch of this invention except where specific materials have been called out.

It is seen that by selectively securing the height fastener to the moveable central leg, the maximum travel of the moveable post downward through the collar is defined every time as that predetermined amount. The disc 33D of the fastener impacts the coupler at the point of maximum travel. This permits the collar 31 which rests upon the disc washer to threadedly engage the coupler's external threads to retain the moveable post at a set location by providing a releasably securable leg in accordance with the mode of this invention, ease of function is obtained as compared to my previous patent.

Since certain changes may be made in the above apparatus without departing from the scope of the invention herein involved, it is intended that all matter contained in the above description and shown in the accompanying drawings shall be interpreted as illustrative and not in a limiting sense.

I claim:

1. In an adjustable crutch having an arm piece, and a base boot, with a pair of spaced fixed lateral external posts disposed on one end in the arm piece and on the other end in the base boot, the improvement comprising in combination:

(A) an inverted T-shaped base boot having three arms, one of which is a central arm which terminates at one end in an extension coupler, said central arm having a vertical throughbore, said coupler having an outside threaded area;

(B) a longitudinally moveable central leg having a cap at one end thereof, said leg's capped end being nestible in said arm piece, and the moveable central leg being moveably disposed through said extension coupler;

(C) a coupling collar having a central opening therein, said collar encircling said central leg and being freely moveable therealong, said coupling collar having internal threads for threaded engagement with the outside threads of said extension coupler;

(D) a height adjustment fastener selectively securable to said moveable central leg, said adjustment fastener having both upward and downward movement limiting means for said coupling collar thereon, which movement limiting means cooperate with said coupling collar for preventing movement of said collar past said fastener, said upward movement limiting means selectively securing said fastener to said central leg, and said collar normally resting on said downward movement limiting means;

whereby when said crutch is in a first closed position with the moveable central leg's cap nested in the arm piece, and said fastener is selectively secured at a desired location on said moveable leg, the coupling collar rests on said fastener unengaged, and when it is desired to use said crutch, the central leg's cap is unnested, the moveable central leg is moved downwardly through said coupler until the fastener impacts said coupler such that the collar can be threadedly engaged to said coupler, the extension of said leg being defined by the position of the fastener on said leg.

2. The crutch of claim 1 further including hand grip retainer means mounted on said lateral posts and a handgrip.

3. The crutch of claim 2 wherein the hand grip retainers are adjustably mounted to said lateral posts.

4. The crutch of claim 1 wherein the height adjustment fastener comprises a tubular member having a disc washer on its underside of greater diameter than the tubular member, which disc serves as the movement limiting means for said collar; and said collar has an inward extending lip, the opening through said lip being of a lesser diameter than the diameter of said disc of said height adjustment fastener.

5. The crutch of claim 1 wherein the extension coupler is integrally formed as part of the base boot.

6. The crutch of claim 1 wherein the central leg has a series of pairs of aligned vertical apertures, and the means to selectively secure the height adjustment fastener to the central leg is an Allen type screw disposed through said fastener and through a pair of said aligned apertures in said central leg.

7. The crutch of claim 1 wherein the central moveable post has a lower end and a rubber foot is disposed thereon.

8. The crutch of claim 1 wherein the cap of said central leg is a magnetic material, and further wherein the arm piece includes a magnetized receiver for said leg and cap.

9. The crutch of claim 1 wherein the cap of said leg is covered with a layer of one part of a hook and loop fastener, and the arm piece includes a receiver for said cap and said cap includes the other part of a hook and loop fastener.

10. The crutch of claim 1 wherein the arm piece includes a receiver for said central leg, and said receiver has snap means to engage and releaseably retain said leg's cap.

11. The crutch of claim 1 including a hand grip mounted to said hand grip retainers.

12. The crutch of claim 1 including at least one means on said central leg to prevent rotation thereof.

13. The crutch of claim 11 wherein the arm piece has a rubber cover thereon.

14. The crutch of claim 12 wherein the antirotation means is at least one intrusion along the length of the central leg and one extrusion into the throughbore of the coupler.

15. The crutch of claim 4 wherein said central leg includes rotation prevention means thereon, to prevent rotation thereof.

16. In an adjustable crutch having an arm piece, and a base boot, with a pair of spaced fixed lateral external posts disposed on one end in the arm piece and on the other end in the base boot, the improvement comprising in combination:

(A) an inverted T-shaped base boot having three arms, one of which is a central arm which terminates at one end in an extension coupler, said central arm having a vertical throughbore, said coupler having an outside threaded area of a wider cross section than the rest of said coupler;

(B) a longitudinally moveable central leg having a magnetic cap at one end thereof, said leg's capped end being nestible in said arm piece, and the moveable central leg being moveably disposed through said extension coupler;

(C) a coupling collar having a central opening therein, said collar encircling said central leg and being freely moveable therealong, said coupling collar having internal threads for threaded engagement with the outside threads of said extension coupler;

(D) a height adjustment fastener selectively securable to said moveable central leg, said adjustment fastener having both upward and downward movement limiting means for said coupling collar thereon, which movement limiting means cooperate with said coupling collar for preventing movement of said collar past said fastener, said upward movement limiting means selectively securing said fastener to said central leg, and said collar normally resting on said downward movement limiting means;

(E) the arm piece having a receiver for said central leg's cap, and a magnet disposed in said receiver to releaseably retain said cap in said receiver.

whereby when said crutch is in a first closed position with the moveable central leg's cap nested in the arm piece, and said fastener is selectively secured at a desired location on said moveable post, the coupling collar rests on said fastener unengaged, and when it is desired to use said crutch, the central leg's cap is unnested, the moveable central leg is manually moved downwardly through said coupler until the fastener impacts said coupler such that the collar can be threadedly engaged to said coupler, the extension of said leg being defined by the position of the fastener on said leg.

17. The crutch of claim 16 wherein the central leg has a series of pairs of aligned vertical apertures, and the means to selectively secure the height adjustment fastener to the central leg is an Allen type screw disposed through said fastener and through a pair of said aligned apertures in said central leg, and further wherein the central moveable post has a lower end and a rubber foot is disposed thereon.

18. The crutch of claim 16 wherein the height adjustment fastener comprises a tubular member having a disc attached on its underside of greater diameter than the tubular member, which disc serves as the movement limiting means for said collar; and said collar has an inward extending top lip, the opening through said lip being of a lesser diameter than the diameter of said disc of said height adjustment fastener.

19. The crutch of claim 18 wherein the central leg has a series of pairs of aligned vertical apertures, and the means to selectively secure the height adjustment fastener to the central leg is an Allen type screw disposed through said fastener and through a pair of said aligned apertures in said central leg.

20. The crutch of claim 1 wherein the cap of the central leg is magnetic and is releaseably maintained by an aligned magnet disposed within the arm piece.

21. The crutch of claim 1 further including crimps in said arm piece to assist in the releasable retention of said cap.

22. The crutch of claim 9 further including crimps in said arm piece to assist in the releasable retention of said cap.

* * * * *